US007736594B1

(12) United States Patent
Grudzien et al.

(10) Patent No.: US 7,736,594 B1
(45) **Date of Patent: *Jun. 15, 2010**

(54) REACTION SURFACE ARRAY DIAGNOSTIC APPARATUS

(75) Inventors: Jennipher Grudzien, Metomora, MI (US); Charles M. NcGrath, Bend, OR (US)

(73) Assignee: Grace Bio-Labs, Inc., Bend, OR (US)

( * ) Notice: Subject to any disclaimer, the term of this patent is extended or adjusted under 35 U.S.C. 154(b) by 551 days.

This patent is subject to a terminal disclaimer.

(21) Appl. No.: 10/349,347

(22) Filed: Jan. 22, 2003

Related U.S. Application Data

(60) Provisional application No. 60/351,008, filed on Jan. 22, 2002.

(51) Int. Cl.
*B01L 3/00* (2006.01)

(52) U.S. Cl. ..... 422/102; 422/104

(58) Field of Classification Search ..... 422/102, 422/104, 82.05
See application file for complete search history.

(56) References Cited

U.S. PATENT DOCUMENTS

| | | | | |
|---|---|---|---|---|
| 3,464,842 | A | 9/1969 | Jackstadt | 428/195.1 |
| 3,726,754 | A | 4/1973 | White | |
| 3,726,767 | A | 4/1973 | White | |
| 3,745,091 | A | 7/1973 | McCormick | |
| 3,883,398 | A | 5/1975 | Ono | |
| 4,039,247 | A * | 8/1977 | Lawman et al. | 359/398 |
| 4,299,920 | A | 11/1981 | Peters | |
| 4,682,890 | A | 7/1987 | de Macaria et al. | |
| 4,978,503 | A * | 12/1990 | Shanks et al. | 422/58 |
| 5,192,503 | A * | 3/1993 | McGrath et al. | 359/398 |
| 5,424,213 | A | 6/1995 | Mougin | |
| 5,571,721 | A | 11/1996 | Turner | |
| 5,591,646 | A * | 1/1997 | Hudson et al. | 436/518 |
| 5,800,785 | A | 9/1998 | Bochner | |
| 5,972,694 | A | 10/1999 | Mathus | |
| 6,037,168 | A * | 3/2000 | Brown | 435/288.3 |
| 6,096,562 | A | 8/2000 | Bunn et al. | |
| 6,225,109 | B1 * | 5/2001 | Juncosa et al. | 435/288.5 |
| 6,277,629 | B1 | 8/2001 | Wolf et al. | |
| 6,376,233 | B1 | 4/2002 | Wolf et al. | |
| 6,426,050 | B1 | 7/2002 | Pham et al. | |
| 6,436,351 | B1 | 8/2002 | Gubernator et al. | |
| 6,485,690 | B1 | 11/2002 | Pfost et al. | 422/102 |

(Continued)

OTHER PUBLICATIONS

Mendoza, et al., "High-Throughput Microarray-Based Enzyme-Linked Immunosorbent Assay (ELISA)," (BioTechniques 27.778-788, Oct. 1999).

(Continued)

*Primary Examiner*—Jill Warden
*Assistant Examiner*—Natalia Levkovich
(74) *Attorney, Agent, or Firm*—Alleman Hall McCoy Russell & Tuttle LLP

(57) ABSTRACT

A reaction surface array diagnostic apparatus and method of making the same includes a substrate carrying a plurality of reaction surfaces and a gasket having a plurality of through bores, each alignable with one of the reaction surfaces and forming a fluid tight well about each reaction surface when the gasket is sealingly affixed to the substrate. In one aspect, the gasket and the substrate are mounted in a support. In another aspect, a plate having a plurality of through bores is mountable on the gasket and substrate. Clamp members engage opposite side edges of the plate, the gasket and the substrate.

18 Claims, 12 Drawing Sheets

U.S. PATENT DOCUMENTS

| | | | | |
|---|---|---|---|---|
| 6,623,701 | B1 * | 9/2003 | Eichele et al. | 422/102 |
| 6,699,665 | B1 * | 3/2004 | Kim et al. | 435/6 |
| 7,063,979 | B2 | 6/2006 | MacBeath et al. | |
| 2001/0001644 | A1 | 5/2001 | Coffman et al. | |
| 2001/0007642 | A1 | 7/2001 | Peiglin | |
| 2001/0051113 | A1 | 12/2001 | Juncosa et al. | |
| 2002/0110925 | A1 | 8/2002 | Mansky et al. | 436/180 |
| 2002/0141905 | A1 | 10/2002 | Sha et al. | |
| 2002/0192811 | A1 | 12/2002 | Pitt et al. | 435/297.5 |

OTHER PUBLICATIONS

Corning, *Hybridization Chamber*, product description, publication date unknown.

TeleChem International, Inc., *Hybridization Cassettes Handbooks*, product description, publication date unknown.

MWG Biotech, Inc., *Hybridization Chamber*, product description, publication date unknown.

Genetix, *Hybridization Chamber, product description*, publication date unknown.

Secure Seal Hybridization Chambers, Grace Bio-Labs, Inc., PO Box 228, Bend, OR 97709. Publication date May 22, 2000.

CultureWell, MultiSlip & SecureSlip, Grace Bio Bio-Labs, Inc., PO Box 228, Bend, OR 97709. Publication date May 22, 2001.

CultureWell, MultiWell Coverslip Cell Culture Inserts, Bio-Labs, Inc., PO Box 228, Bend, OR 97709. Publication date 2000.

* cited by examiner

FIG - 5A
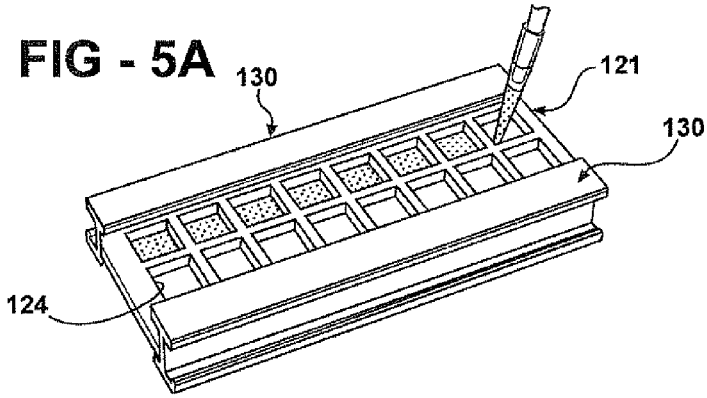
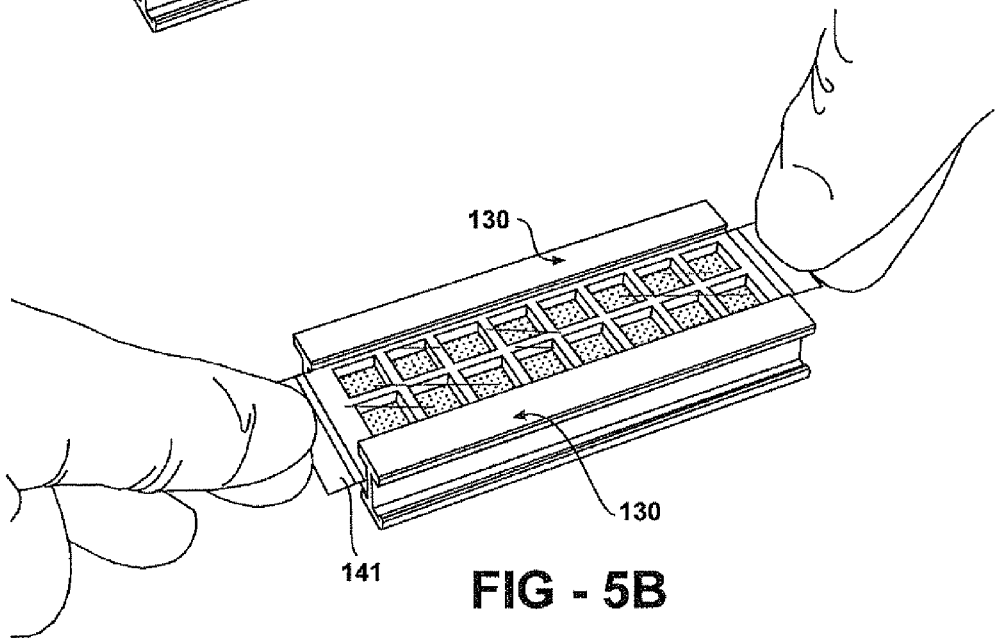
FIG - 5B
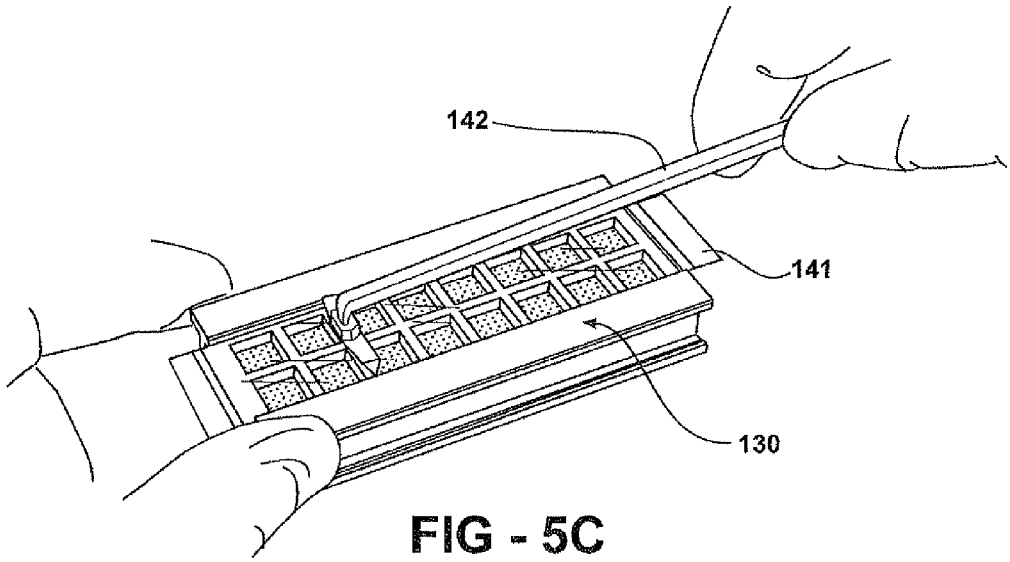
FIG - 5C

REACTION SURFACE ARRAY DIAGNOSTIC APPARATUS

CROSS REFERENCE TO CO-PENDING APPLICATION

This application claims priority of the Jan. 22, 2002 filing date of provisional patent application Ser. No. 60/351,008, the contents of which are incorporated herein in its entirety.

BACKGROUND

In situ diagnostic techniques have evolved into a high speed, highly automated process. Standard size test chambers in the form of microarrays of columns and rows of individual wells are formed by means of a microtitre plate or plates on a substrate to which the microtitre plate(s) is attached. The standard matrix of columns and rows is available in different sizes to suit different automated equipment.

It would be desirable to provide a simple and expedient means for creating a plurality of reaction surfaces on microscope slides in the footprint of a standard microtitre plate for use in automated in situ diagnostic apparatus. It would also be desirable to provide a reaction surface array diagnostic apparatus which provides an easy assembly of the individual apparatus components; yet an assembly which is easily disassembled. It would also be desirable to provide a reaction surface array diagnostic apparatus which includes means for securely retaining the apparatus components together during use.

SUMMARY

The present invention is a reaction surface array diagnostic apparatus and method of making the same.

In one aspect, the apparatus includes a substrate carrying a plurality of reaction surfaces. A gasket is sealingly mounted over the substrate. The gasket includes a plurality of through bores which form reaction chambers when the gasket is sealingly affixed to the substrate.

In one aspect, the gasket is a silicone gasket having at least one releasably adhesive surface for securing the gasket in a fluid tight manner to the substrate. The depth of each reaction chamber formed about each reaction surface by the gasket can be varied by varying the thickness of the gasket.

In another aspect, the apparatus of the present invention includes a planar support, at least one substrate mounted in the support, a plurality of reaction surfaces fixed on the substrate, and reaction chambers formed about each reaction surface on the substrate. In this aspect, the gasket can be a silicone gasket with a plurality of wells formed in the gasket and forming the reaction chambers over the reaction surfaces on the substrate when the gasket is affixed to the substrate.

A cover may be applied over the substrate and the reaction chambers to seal the open end of each reaction chamber. The depth of the reaction chambers may be varied by varying the thickness of the gasket.

In another aspect, the clamp means for clamping the plate, the gasket and the substrate together comprises a pair of clamp members having legs extending from a central wall. Preferably, each clamp member has oppositely extending channels formed between the legs for joining two side-by-side arranged stacks of joined plate, substrate and gasket into an array.

In another aspect, a tray has an opening for releasably receiving the array, the array defining an overall size equaling the foot print of a standard microtitre plate.

In another aspect, an elongated open ended notch may be formed in the plate for receiving a projection formed on the end of at least one of the side legs of each clamp member for securing the clamp member to the joined substrate, gasket and plate.

In another aspect of the invention, a method of preparing a reaction surface array diagnostic apparatus is disclosed. The method comprises the steps of:

providing a substrate;

providing a plurality of reaction surfaces on the substrate;

providing a gasket having a plurality of bore extending therethrough; and adhering the gasket to the plate and aligning the bores in the gasket with the reaction surfaces on the substrate to form a well over each reaction surface.

The apparatus and method of the present invention provide an expedient means for simultaneously conducting reactions on a plurality of reaction surfaces. The use of the gasket with through bores exclusively with a substrate carrying the reaction surfaces forms the reaction chambers or wells about each reaction surface by a minimal number of components.

The use of the clamp members in another aspect of the invention insures that the reaction chambers remain sealed during the reaction.

BRIEF DESCRIPTION OF THE DRAWING

The various features, advantages and other uses of the present invention will become more apparent by referring to the following detailed description and drawing in which:

FIGS. 5A-5C are perspective views showing further assembly and use steps of the aspect of the invention shown in FIG. 3 and FIGS. 4A-4E;

DETAILED DESCRIPTION

The present invention is a reaction surface array diagnostic apparatus 10 which creates a plurality of reaction surfaces on substrates, microscope slides, such as in the footprint of a standard microtitre plate.

Figure 1:
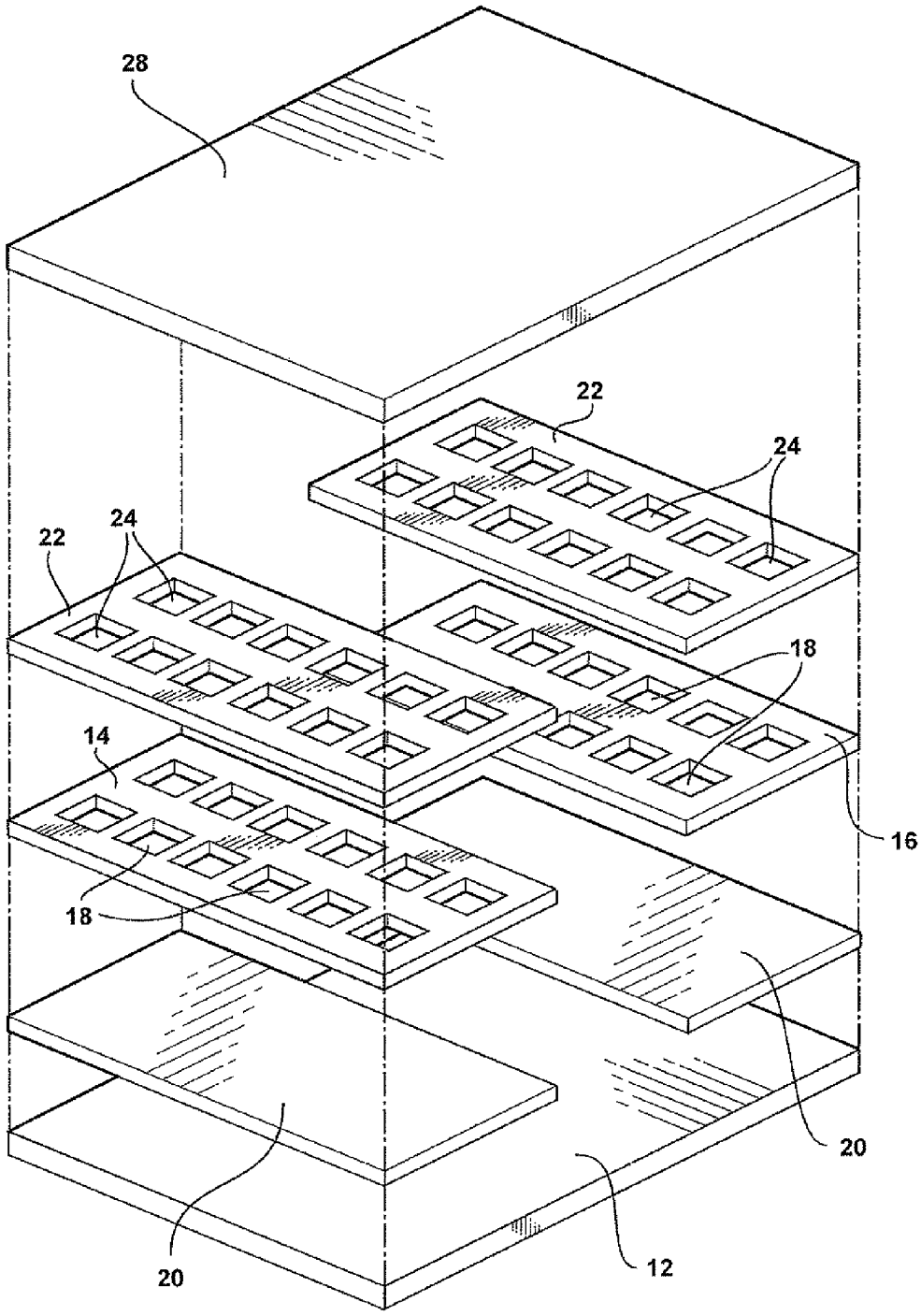
FIG. 1 is an exploded, perspective view showing one aspect of the present invention.

One aspect of the present invention is shown in FIG. 1 wherein the apparatus 10 includes an optional carrier plate 12 which has a generally planar surface and may also include raised sidewalls to form a receptacle or tray-like support as described later. The plate 12 is formed of glass or plastic, with transparent glass or plastic being preferred.

The plate 12 is sized to support a substrate, such as one or more standard sized (1"×3") microscope slide(s). In a preferred example, the plate 12 has the exterior dimensions of a 96 well plate (86 mm×128 mm) to receive four microscope slides 14, 16, etc., in a side-by-side array. The slides 14 are standard microscope slides formed of either glass or plastic, with generally transparent materials being preferred.

A plurality of reaction surfaces 18 are formed on each slide 14. The reaction surfaces 18 are in the form of an array of microporous films, such as nitrocellulose films, or other films, for example only, or treated glass surfaces, such as glass treated with a protein binding solution. The reaction surfaces 18 are fixed in position on one surface of each slide 14 in a standard microarray. For example, the microporous or nitrocellulose films 18 are spun cast onto the surface of each slide 14 in the form of droplets and allowed to dry.

The slides 14 are positioned on the plate 12, preferably in a non-movable manner. An optional fixing element 20 may be employed to securely hold or fix each slide 14 in position on the plate 12. By way of example only, the fixing element is in the form of a thin (0.2 mm) clear silicone sheet 20 which provides the necessary friction to retain each slide 14 in position on the plate 12. The clear or transparent nature of the silicone sheet 20 also allows high resolution microscopy for cells arrayed on the films or reaction surfaces 18. At the same time, the silicone sheet 20 allows the slides 14 to be removed after reactions are completed.

The microporous films 18 which act as molecular binding or reaction areas on each slide 14 have a center-to-center spacing based on 9 mm in both the vertical and horizontal directions. A 9 mm spacing gives a footprint of a 96 well microtitre plate. A 4.5 mm center-to-center spacing gives a footprint of a 384 well plate.

Reaction chambers are formed about each reaction surface 18 to provide chambers for receiving cells, proteins, antibodies, nucleic acid and other reaction elements for reaction with the films or treated areas 18. The reaction chambers are formed, according to the present invention, by a gasket 22, such as a silicone gasket, which has a plurality of through bores or wells 24 which are arrayed in the same 9 mm or 4.5 mm vertical and horizontal array spacing as the reaction surfaces 18 which is the same array combination as a standard microtitre plate. This allows each through bore or well 24 to align with and surround one reaction surface 18 on the slide 14. The use of the silicone as the material to form the gasket 22 secures the reaction chambers in a stationary, non-movable position on each slide 14 about the reaction surfaces 18 due to the inherent sticky, but releasably nature of this material.

However, it is feasible in the present invention to fluidically link two, three or more adjacent wells 24 together by small diameter flow channels extending through the gasket 22 between the wells 24. Any number and arrangement of wells 24 may be fluidically coupled in the gasket 22 while still retaining the preset center-to-center spacing between the wells 24

At the same time, the thickness of the gasket 22 may be varied or multiple gaskets may be stacked one on top of the other to provide a pre-determined reaction chamber or well depth for a particular volume of reactant.

The use of the gasket 22 to form the reaction chambers also prevents leaking between adjacent reaction chambers since the gasket 22 seals to the slide 14 to isolate each reaction surface 18 from adjacent reaction surfaces 18.

An optional cover member 28 may be applied over each gasket 22 and slide 14. Preferably, one single large cover 28, having the approximate dimensions of the plate 12, is applied over all of the gaskets 22 and the slides 14 mounted on the plate 12. The cover 28, which may be formed of plastic or glass and, preferably, transparent plastic or glass, is held in position sealing each reaction chamber formed by the wells 24 by engagement with the silicone gasket 22.

Alternately, the plate 24 may comprise four individual plates, each having the dimensions of one of the standard microscope slides 14.

In use, the reaction surfaces 18 are applied in the desired array to each slide 14. The slides 14 are then secured in position on the plate 12 by means of the fixing element or gasket 20.

One gasket 22 is then applied over each slide 14 to form one reaction chamber over each reaction surface 18. A particular reactant(s) is then applied to each reaction chamber or well 24. The optional cover 28 is then applied over the gaskets 22. At the completion of the reaction time, the elements are disassembled in a reverse order.

Figure 2:
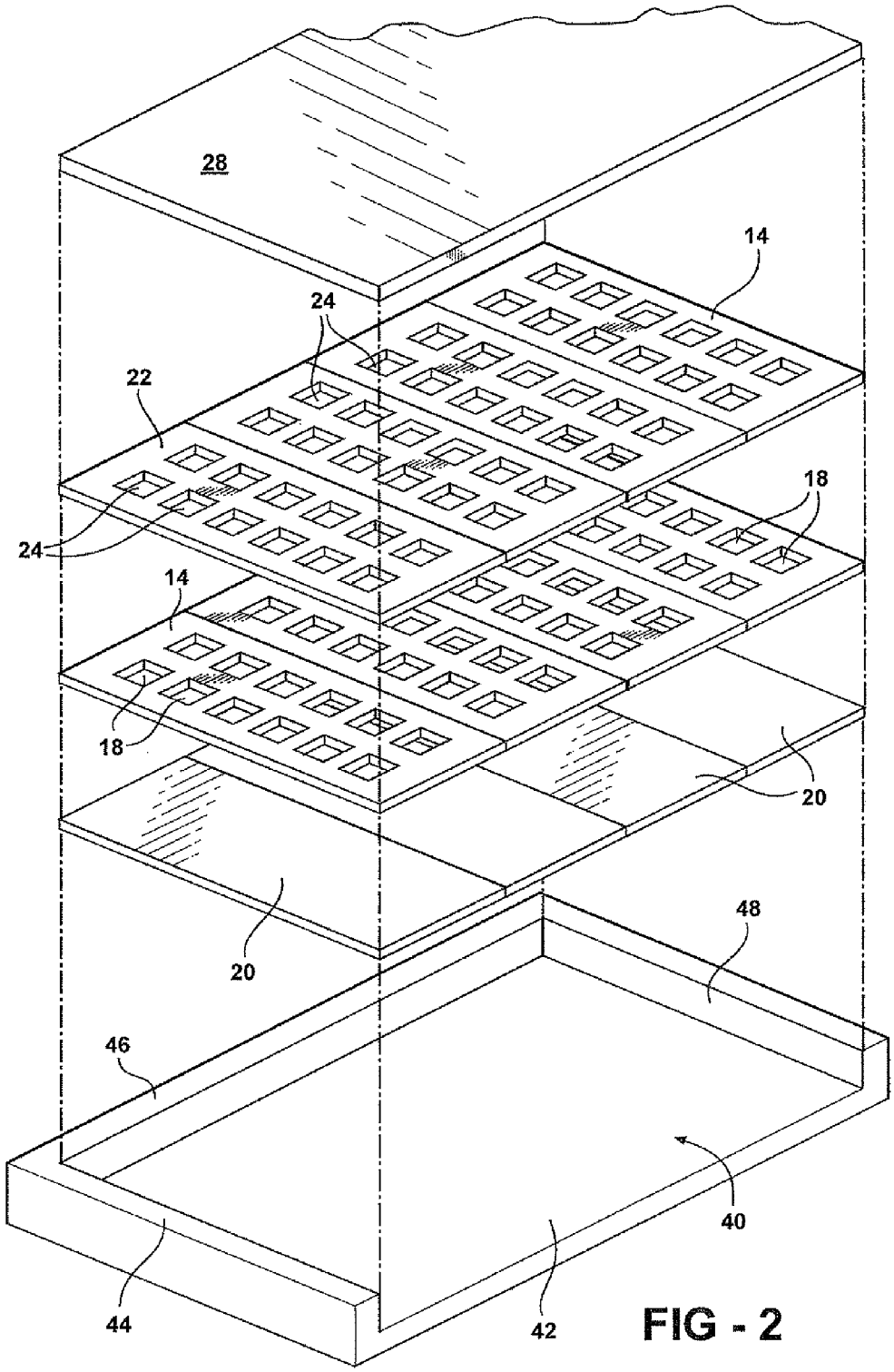
FIG. 2 is an exploded, perspective view of another aspect of the present invention.

FIG. 2 depicts an alternate aspect of the present invention which utilizes the same fixing element or gaskets 20, standard microscope slides 14, each having reaction surfaces 18 formed thereon, as well as the reaction chamber forming gaskets 22 and the optional cover 28 as described above and shown in FIG. 1.

In this aspect of the invention, the slides 14 and the fixing elements or gaskets 20 are mounted in a support or tray 40. The tray 40 has a generally planar central portion 42 which receives the fixing elements or gaskets 20 and the slides 14 in a side-by-side arrangement. The tray 20 includes a raised sidewall formed of interconnected sides 44, 46 and 48 which may be integrally formed with the planar central portion 42, but extend upward from the plane of the central portion 42 to form a raised edge along at least three sides of the central portion 42. The sides 44, 46 and 48 form a continuous support for positioning the slides 14 in the desired array on the tray 40 in the standard microtitre arrangement. The sides 44, 46 and 48 also cooperate with the fixing elements or gaskets 20 to hold the slides 14 in a stationary, non-movable position on the central portion 42 of the tray 40.

It should be noted that one side edge of the central portion 42 of the tray 40 is not provided with a raised side flange. This is to facilitate gripping of the slides 14 when inserting or removing the slides 14 to and from the tray 40. Otherwise, the operation of the tray 40 is the same as that described above for the invention shown in FIG. 1.

Referring now to FIGS. 3-11, there is depicted another aspect of the present invention. In this aspect, the diagnostic apparatus 100 also uses a substrate 102. The substrate 102 is also formed of glass or plastic, with transparent glass or plastic slides being preferred.

In one aspect, the substrate 102 is a microscope slide. Such slides are typically 1 inch by 3 inches (25 mm×75 mm) plain glass or plastic, such as polycarbonate, PMP or polystyrene. The glass microscope slides may be treated with suitable surface treatments for use as reaction surfaces for microarrays and tissue such as aminosilanes, superaldehydes, acylamide, epoxies, and nitrocellulose.

Figure 3:
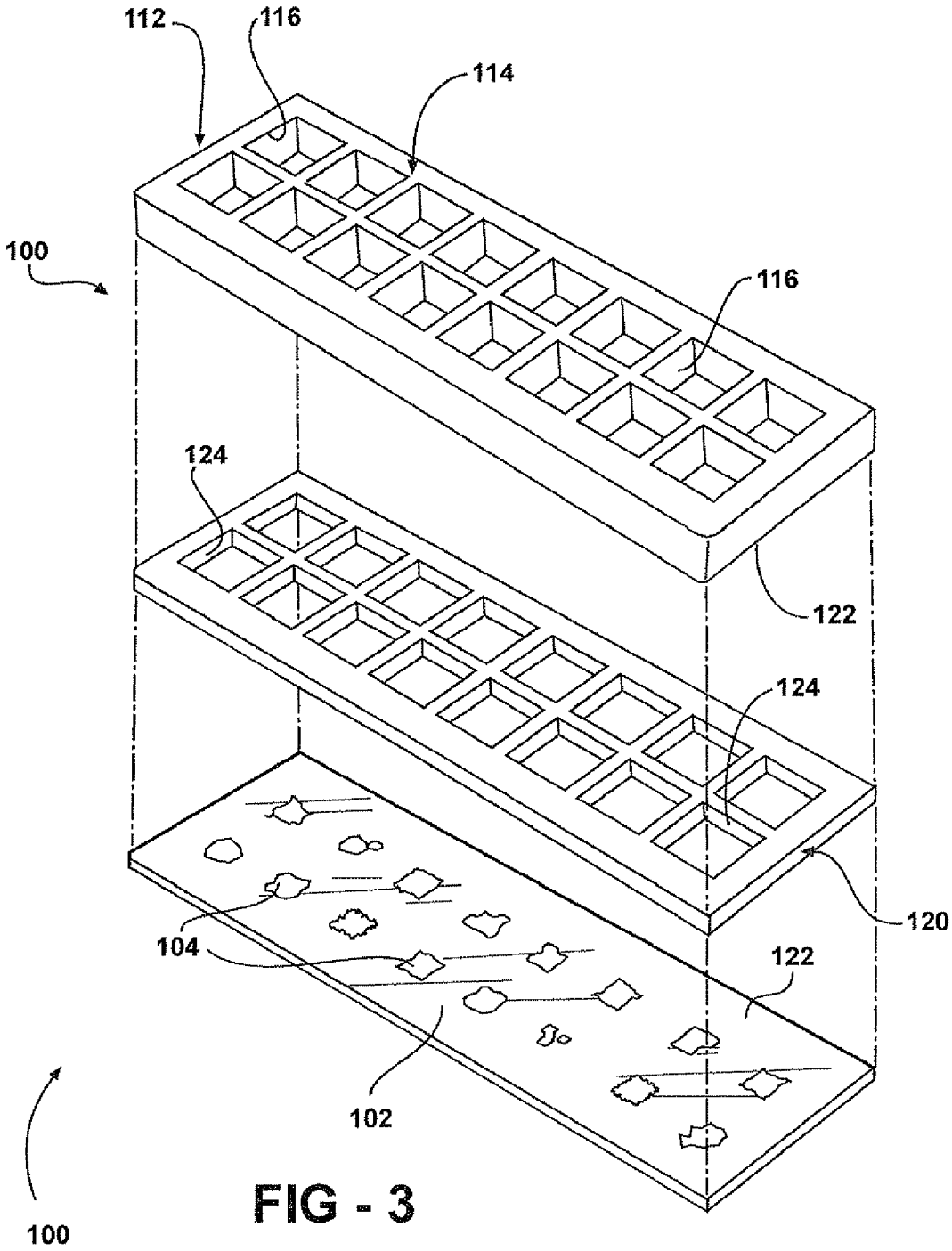
FIG. 3 is an exploded, perspective view of yet another aspect of the present invention.

By example only, the substrate 102 is depicted in FIG. 3 as being in the form of a standard one inch by three inch microscope slide. It will be understood that the dimensions of the substrate 102 may be varied as necessary to suit the needs of a particular application.

A plurality of reaction surfaces 104 are formed on each substrate 102 in the form of an array of microporous films, as described above. The reaction surfaces 104 are fixed in position on one surface of the substrate 102 in a standard microtitre array.

Reaction chambers denoted by reference number 110 in FIG. 6 are formed about each reaction surface 104 to provide wells for receiving cells, proteins, antibodies, nucleic acid or other reaction elements for reaction with the films or reaction surfaces 104. According to the present invention, the reaction chambers are formed by a plate 112 having a shape complimentary to the shape of the substrate 102. A plurality of individual bores 116, each typically having a polygonal shape, such as square bores, are formed through the plate 112 in an array. The wells can have any configuration having the same spacing as standard microplates. For example, the wells can be at 9 mm, 4.5 or 2.25 center to center spacings on a matrix.

The plate 112 is fluidically sealed to the substrate 102 by means of a seal or gasket 120 interposed between a first surface 122 of the plate 112 and one surface 122 of the substrate 102. The gasket 120 can be formed of any compressible material. In one aspect, the seal or gasket means 120 is a silicone gasket having a shape complimentary to the shape of the plate 112 and the substrate 102. The silicone used to form the gasket 120 provides it with sufficient resiliency to-enable it to flex and bend during application to the substrate 102 or to the surface 122 of the plate 112. The seal or gasket 120 has a plurality of through bores 124 which are arranged in an array complimentary to the array of bores 116 in the plate 112. As shown in FIG. 6, the bores 116 in the plate 112 and the bores 124 in the gasket 120 combine to form the well or chamber 110 surrounding each film or reaction surface 104 formed on the substrate 102.

Gasket thicknesses of about 0.5 mm to 2.5 mm can be used. The overall shape of the gasket 120 approximate the shape or the plate 112 and the substrate 102.

The silicone gasket 120 has a certain degree of stickiness which enables the gasket 120 to be fixedly yet releasably secured to the surface 122 of the substrate 102 and, as well, to fixedly yet releasably attach the surface 122 of the plate 112 to an opposite surface of the gasket 120. This cohesiveness is typically sufficient to retain the plate 112 on the gasket 120 in secure watertight engagement with the substrate 102 to prevent cross flow between the various wells or chambers 110.

Enhanced clamping force may be provided by means of a clamp means consisting of a pair of clamp members, denoted by reference number 130. Each clamp member 130 is formed of a resilient material, such as a plastic, and has a length sufficient to securely engage at least a portion of and, preferably, substantially all of the of the generally longer side edges of the substrate 102, the plate 112 and the gasket 120 as shown in FIG. 4, all of which form a stack 121.

Each clamp member 130 is formed as a unitary body of a suitable material, such as plastic. Each clamp member 130 has a central wall 131 and a pair of transversely extending side legs 131 and 132 carried on opposite ends of the central wall 131. Each of the side legs 131 and 132 are formed with arms projecting oppositely from the central wall 131. Thus, side leg 131 is formed of arms 134 and 135; while side leg 132 is formed with oppositely extending arms 136 and 137.

This arrangement forms the clamp member 130 with a generally I cross section. Opposed arms, such as arms 134 and 136 or arms 135 and 137, define opposed open-ended channels 139 with the central wall 131 sized for receiving the longitudinal side edges of two stacks 121, each formed of the substrate 102, gasket 120 and plate 112.

The spacing between the arm pairs 134 and 136 and 135 and 137 is selected to provide a tight fit to provide clamping force along the longitudinally extending side edges of the stack 121.

Added securement between each clamp member 130 and the stack 121 is provided by projections 138 which may be formed on at least one of the arm pairs on the side legs 131 or 132, and, more preferably, on each of the arms of the side legs 131 and 132. As shown on the FIGS. 4D, 6B and 10, projections 138 are formed at the outer ends of each of the arms 134, 135, 136, and 137 and extend out of the plane of each arm 134, 135, 136, and 137 toward an opposite projection 138.

The projections 138 on the end of each side leg 134 and 136 firmly engage the outer surfaces of the plate 112 and the substrate 102. For secure mounting purposes, a recess 140 may be formed along the longitudinal or major dimension axis of one surface of the body 114 of the plate 112 slightly inboard of both of the longitudinally extending side edges. The recesses 140 are configured to receive the projections 138 in a snap-in fit as the clamp members 130 are urged over the side edges of the stack 121 of the substrate 102, gasket 120 and plate 112.

The assembly steps of the diagnostic apparatus 100 will be more clearly understood by reference to the sequential assembly steps shown in FIGS. 4A-6D.

Figure 4A:
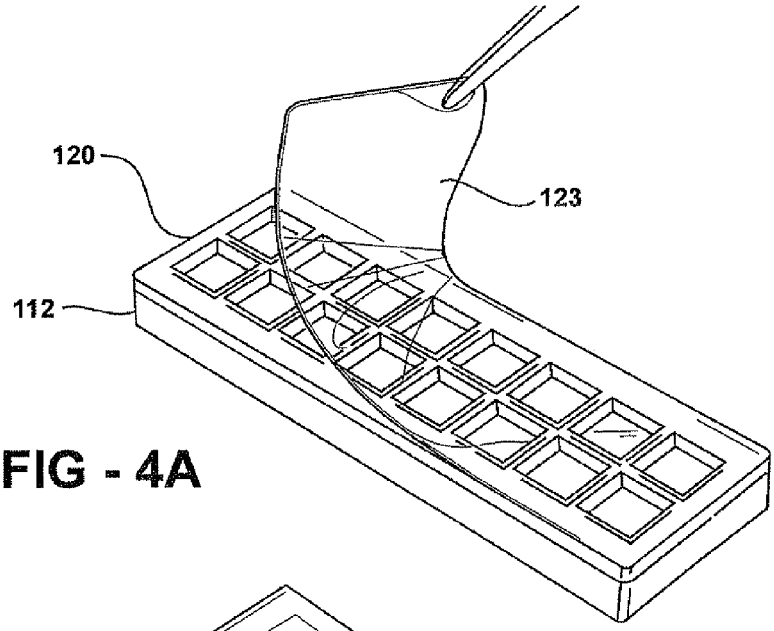
FIGS. 4A-4E are pictorial views showing the assembly steps of the aspect of the invention shown in FIG. 3.
Figure 4B:
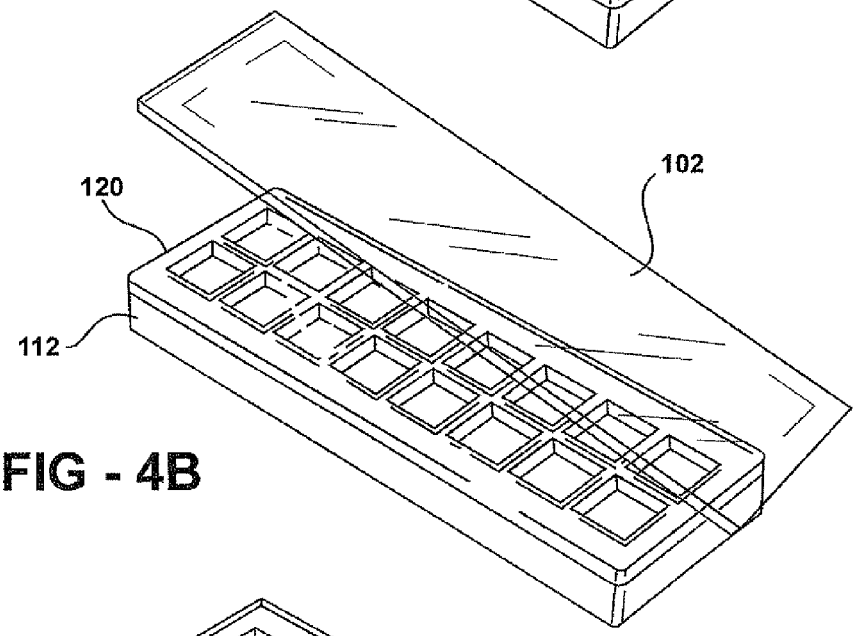
Figure 4C:
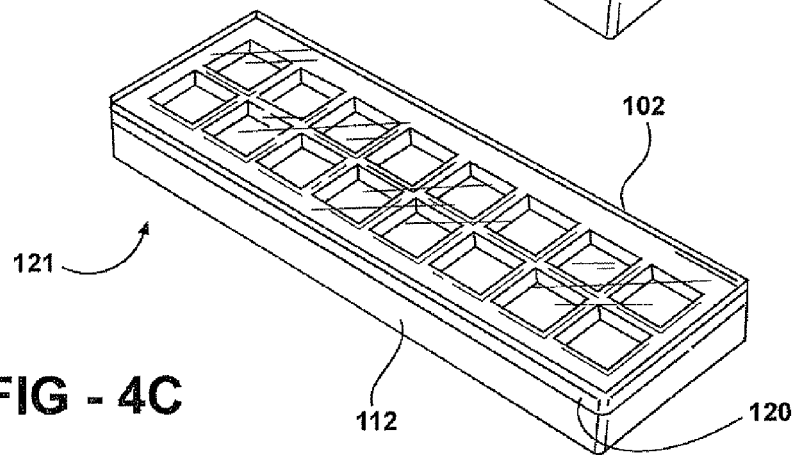

The gasket 120 and the plate 112 are first joined together in a stacked arrangement. The inherent stickiness of the exterior surface of the silicone gasket 120 secures the gasket 120 to the plate 112 in a fluid tight manner, with each of the walls in the gasket 120 aligned with one of the wells in the plate 112. After the release liner 123 is removed from the opposed, exposed surface of the gasket 120, the substrate 102 is then mounted to the gasket 120 with each of the reaction surfaces 104 carried on the substrate 102 facing and disposed within one of the walls formed on the plate 112 and the gasket 120. This completes the stack 121 as shown in FIG. 4C.

Figure 4D:
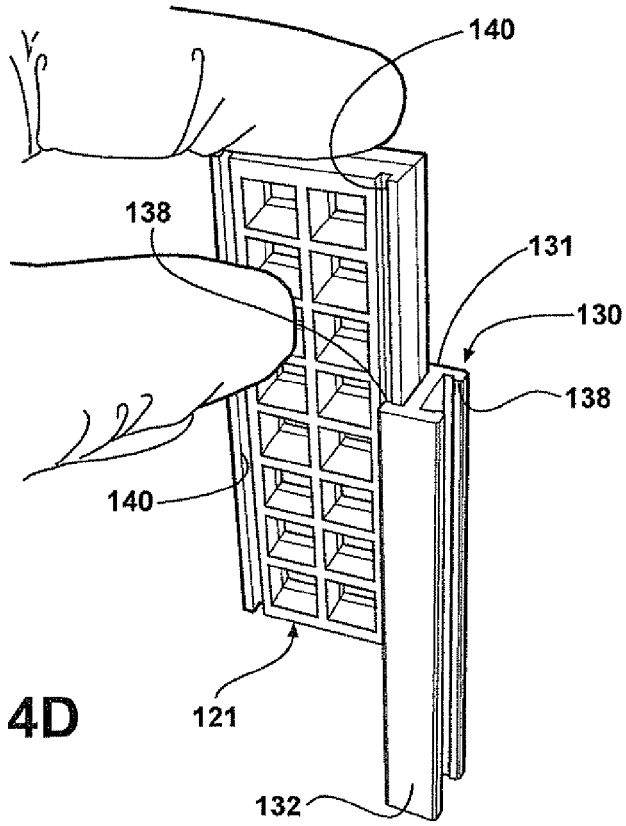

Next, one of the clamp members 130 is engaged with one of the longitudinally extending side edges of the stack 121, with the side edges fully inserted into the open-ended channel formed on one side of the central wall 129 and one of the arm pairs, such as arm pair 134 and 136. In this position, as shown in FIGS. 4D and 4E, the projection 138 on the arm 136 engages the recess 140 formed on one side edge of the plate 112.

Figure 4E:
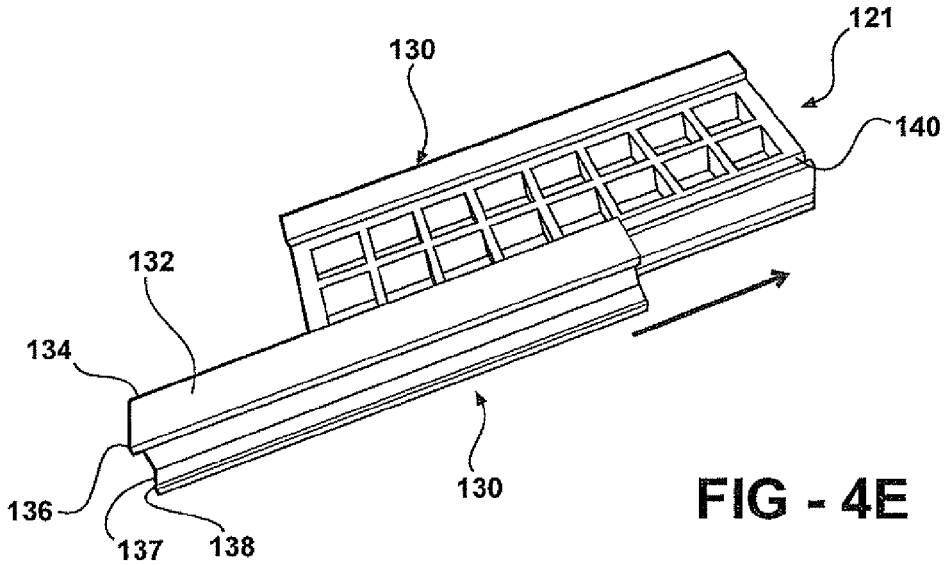

The same process is then repeated for the opposite clamp member 130 as shown in FIG. 4E until the arms 135 and 137 of the opposed clamp member 130 are disposed on opposite sides of the stack 121 of the plate 112, the gasket 120 and the substrate 102.

The stack 121 held together by the clamp members 130 can then be filed with suitable reactant as shown in FIG. 5A. An optional cover 141, shown in FIG. 5B, may be applied to the open end of the wells in the top plate 112 to prevent evaporation of the reactant. A scraper or other suitable tool 142, depicted in FIG. 5C, may be urged along the exposed surface of the cover 141 to smoothly adhere the cover 141 to the top surface of the plate 112.

Figure 6A:
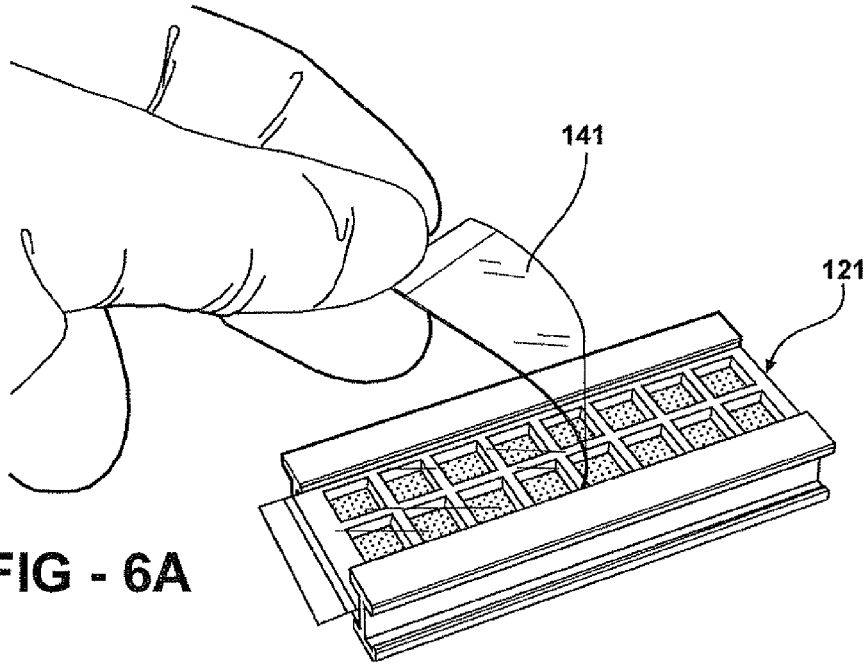
FIGS. 6A-6D are perspective views showing the disassembly steps of the assembly aspect of the invention shown in FIG. 5C.
Figure 6B:
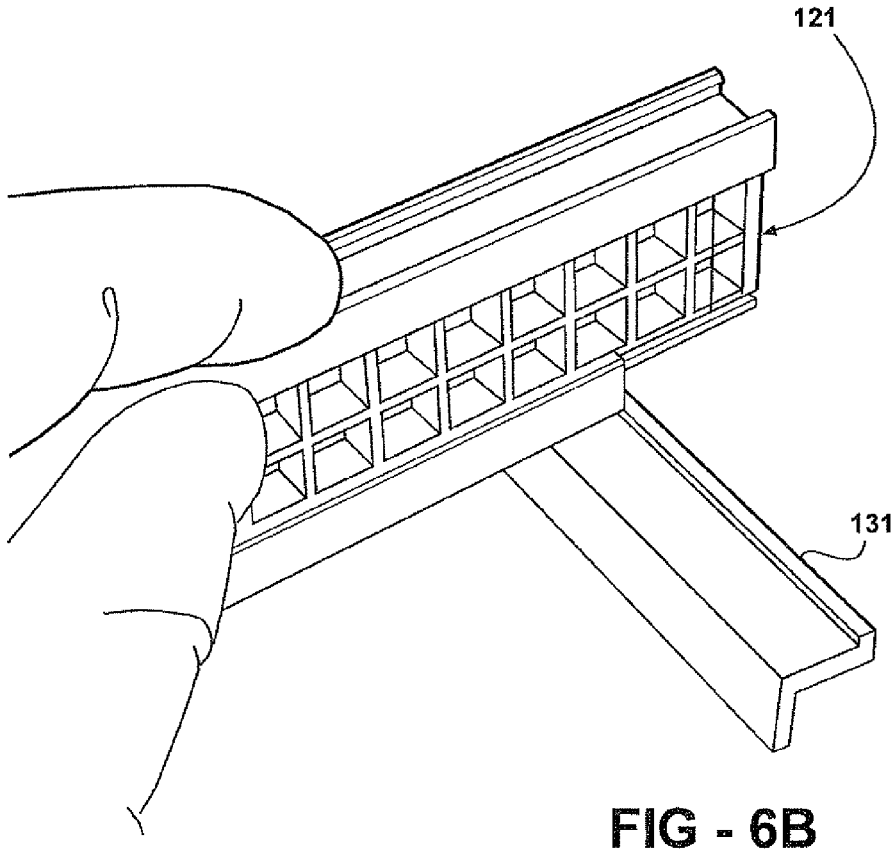
Figure 6C:
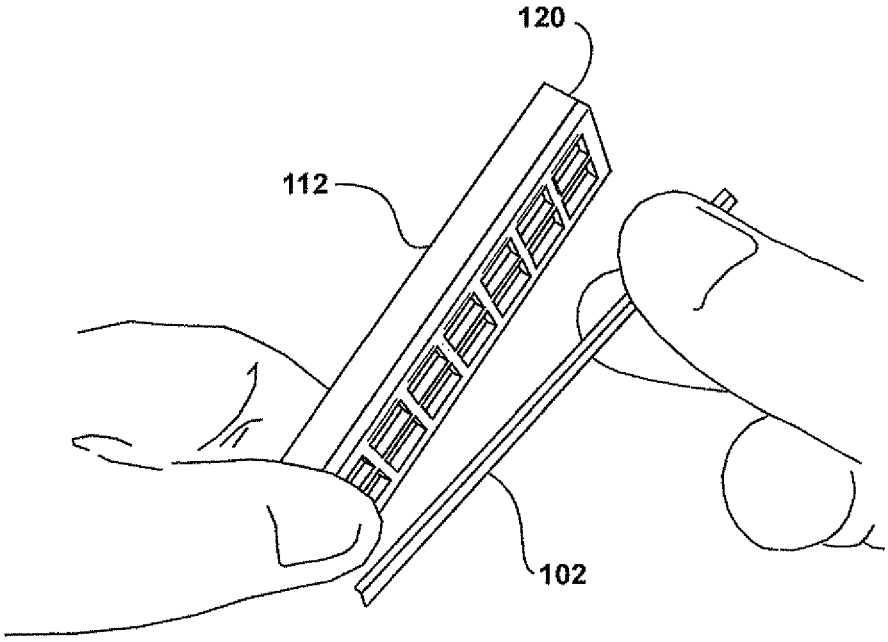
Figure 6D:
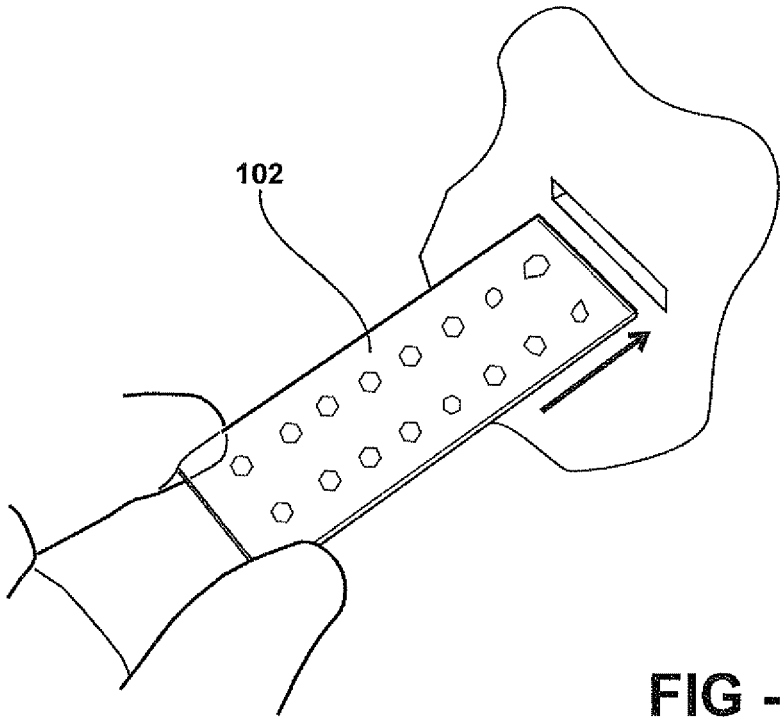
Figure 7A:
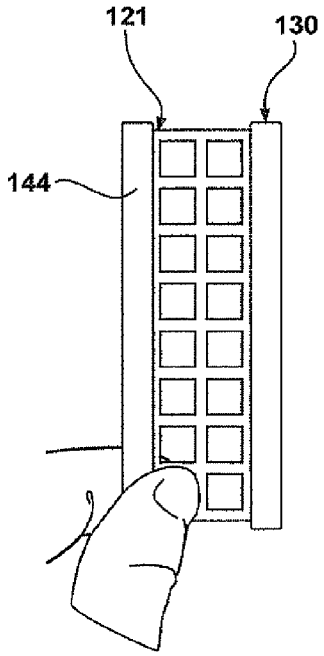
FIGS. 7A-7E are pictorial representations of assembly steps and forming an array of diagnostic apparatus according to the present invention.
Figure 7B:
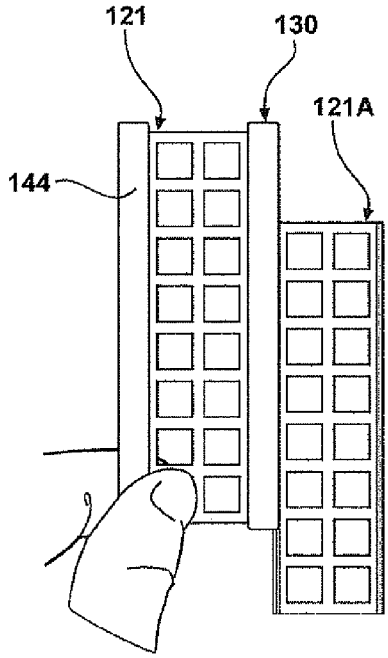
Figure 7C:
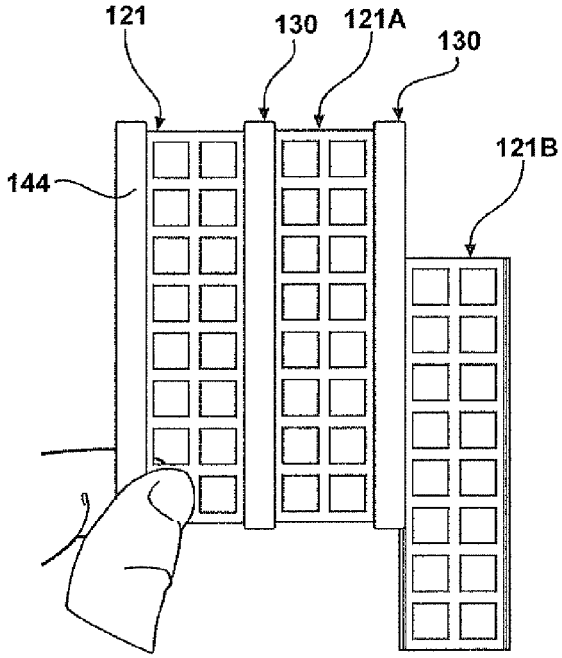
Figure 7D:
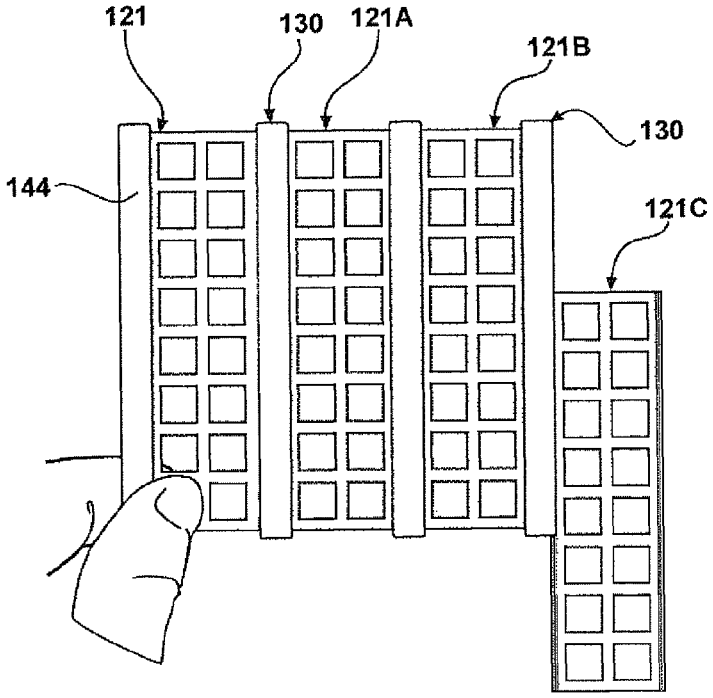
Figure 7E:
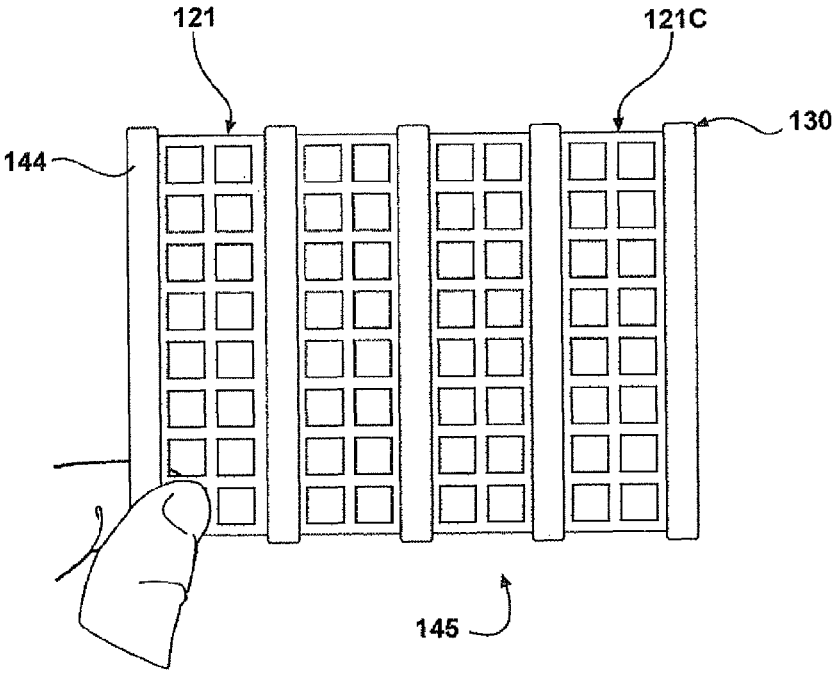
Figure 8:
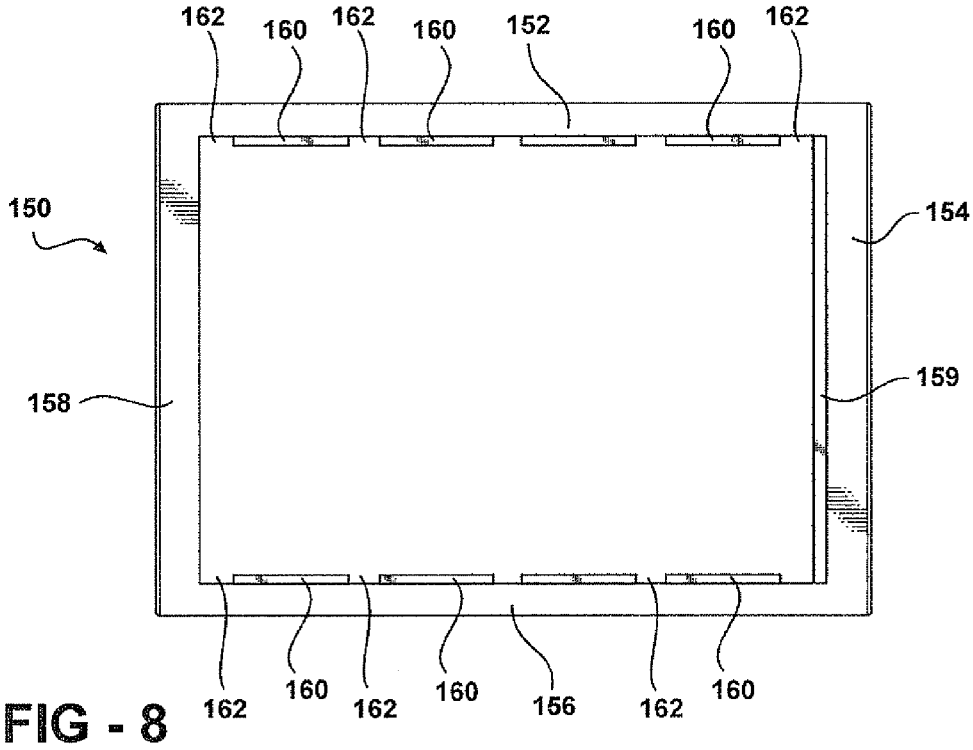
FIG. 8 is a plan view of a tray according to another aspect of the present invention.

Once the reaction has been completed, the cover 140 is as in FIG. 6A is removed and the reactant poured from the wells. The clamp members 130 are removed from the stack 121 by engaging the end of each clamp member 130 with a raised surface 133 on a tool or other support. The substrate 102 may be removed from the gasket 120 and processed as normal.

Figure 10:
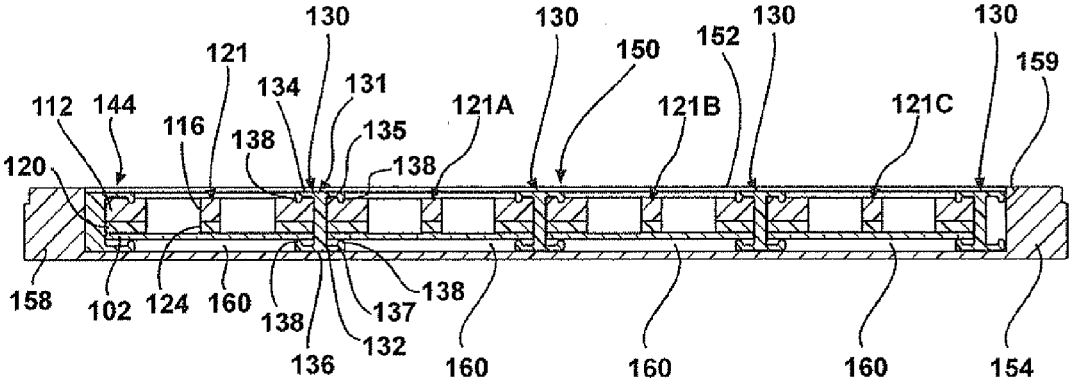
FIG. 10 is a cross-sectional view generally taken along line 10-10 in FIG. 11.
Figure 9:
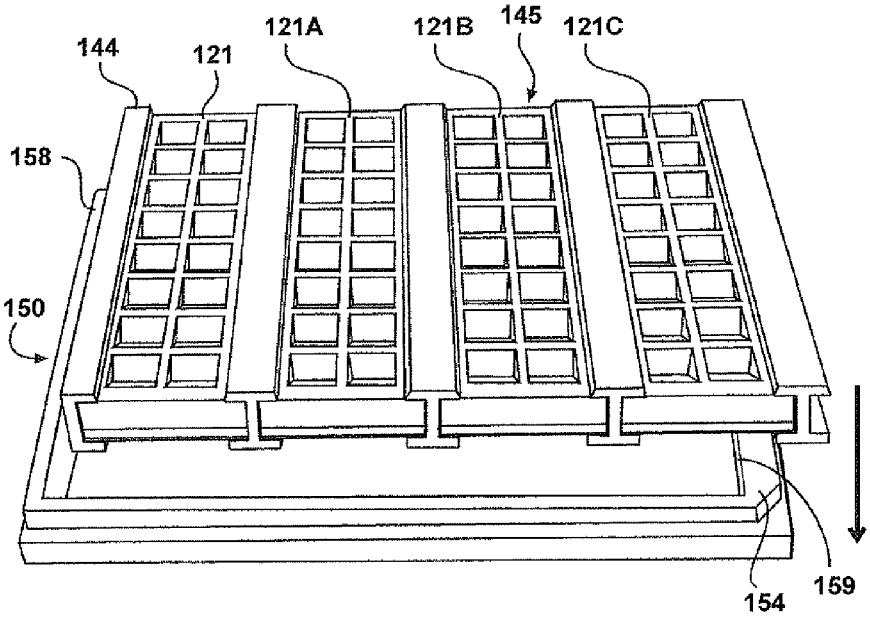
FIG. 9 is a perspective view showing the mounting of the array of FIG. 7A in the tray of FIG. 8.
Figure 11:
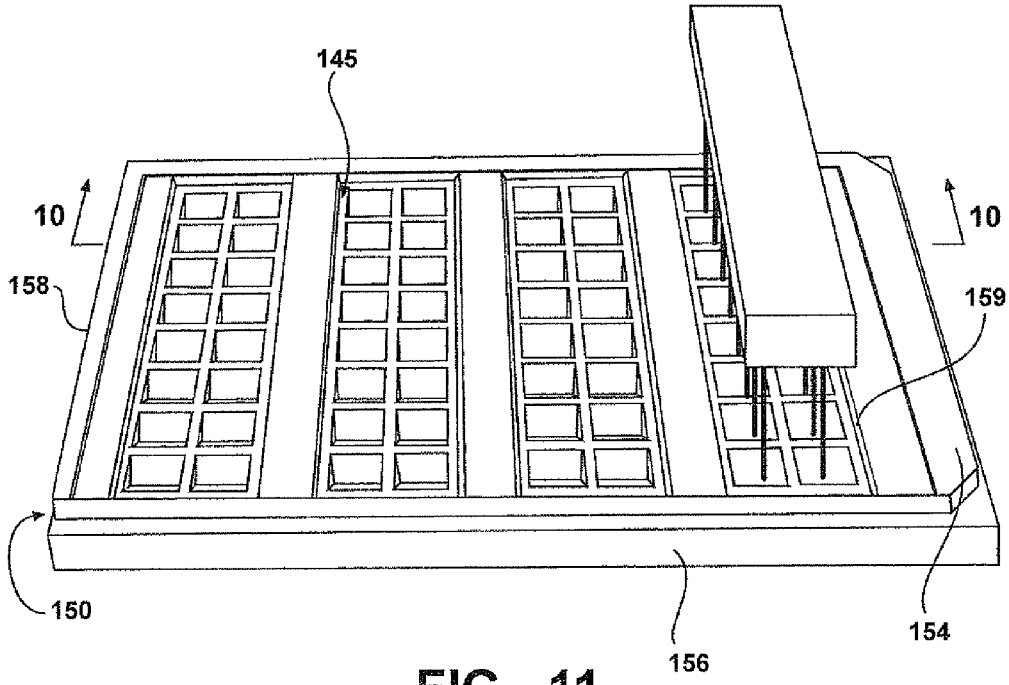
FIG. 11 is a perspective view showing the assembly array and tray of FIGS. 8-10.

Referring now to FIGS. 7A-7E, there is depicted the assembly of multiple stacks 121 into an array having the standard footprint of a microtitre plate. After the initial stack 121 is completed, with a modified clamp member 144 having a generally C-shape and with or without projections 138 on opposed arms attached to one endmost stack 121, adjacent stacks 121A, 121B, 121C are successively slide through the exposed open ended channel formed between the outer ends of additional clamp members 130. This is repeated until four stacks 121, 121A, 121B, and 121C are joined together by separate clamp members 130 in an array 145 shown in FIG. 7E. The array 145 is then mounted in a tray 150 shown in FIGS. 8, 9 and 11 which simplifies the handling of the array 145 in a pipette application, shown in FIG. 11. The tray 150 is formed as a unitary body having a peripheral wall formed of individual, joined wall segments 152, 154, 156, and 158 which define an inner cavity sized to receive the four joined stacks 121, 121A, 121B, and 121C of the array 145. A sloped or beveled edge 159 is formed on an inner top edge of the wall segment 154 to urge the array 145 tightly against the opposed wall segment 158. A plurality of flanges 160 are formed as part of the sidewalls 152 and 156 and project inward into the opening between the wall segments 152 and 156. The flanges 160 define intervening notches all denoted by reference number 162. The flanges 160, as shown in FIG. 10 are engagable by the substrates 102 in each stack 121, etc., when the array 145 of stacks is inserted into the tray 150. The individual clamp members 130 are positioned in the notches 162.

In summary, there has been disclosed a unique reaction surface array diagnostic apparatus which, in one aspect, utilizes a silicone gasket having at least one releasably adhesive surface. The gasket includes a plurality of wells which form chambers around reaction surfaces carried on a substrate or slide to undertake diagnostic reactions. In another aspect, a similar gasket is employed with a rigid plate. Unique clamps are employed for securing the substrate, gasket and plate together.

What is claimed is:

1. A reaction surface array diagnostic apparatus comprising:

a stack, the stack including a planar substrate with a plurality of reaction surfaces predeposited in bound arrays on the planar substrate; a plate having a plurality of wells extending therethrough disposed in a standard microtitre plate well spacing; a gasket, having a releasably adhering surface, sealingly coupling the plate to the planar substrate to form the stack, the gasket having wells disposed in said microtitre plate well spacing and fluidically coupled to the wells in the plate and combining with the wells in the plate to form reaction chambers disposed in said microtitre plate well spacing about the reaction surfaces on the planar substrate; and first and second joinder members each engageable with substantially an entire length of side edges of the stack, each of the joinder members engageable with the side edges at both a top and bottom of the stack adjacent to side walls of the plate, each of the joinder members forming a first channel with a top portion, a bottom portion, and a central portion, with the top portion of the first channel extending outwardly from the central portion, the top portion engageable along the entire length at the top of the stack, the bottom portion of the first channel extending outwardly from the central portion and engageable along the entire length at the bottom of the stack, each joinder member is formed as an I-shaped member.

2. A reaction surface array diagnostic apparatus comprising:

a plurality of stacks, each stack including a planar substrate with a plurality of reaction surfaces pre-deposited in bound arrays on the planar substrate; a plate having a plurality of wells extending therethrough disposed in a standard microtitre plate well spacing; a gasket, having a releasably adhering surface, sealingly coupling the plate to the planar substrate, the gasket having wells disposed in said microtitre plate well spacing and fluidically coupled to the wells in the plate and combining with the wells in the plate to form reaction chambers disposed in said microtitre plate well spacing about the reaction surfaces on the planar substrate;

first, second, and third joinder members, the first and second joinder members engageable with substantially an entire length of side edges of a first stack of the plurality of stacks, the second and third joinder members engageable with substantially an entire length of side edges of a second stack of the plurality of stacks, each of the first, second and third joinder members providing a clamping force to the edges of each of said plurality of stacks;

the plurality of stacks arranged into a unitary planar array, with the wells in all of the plurality of stacks maintaining the microtitre plate well spacing across the array; and a tray having an opening for receiving and supporting the stacks, the tray defining a foot print of a microtitre plate.

3. The apparatus of claim 1 wherein each of the first and second joinder members are slidably engageable with the stack, and where each of the first and second joinder members are in compressive engagement with the stack.

4. The apparatus of claim 3, further comprising a second stack, the second stack including a second planar substrate adapted with a plurality of reaction surfaces predeposited in bound arrays on the second planar substrate; a second plate having a plurality of wells extending therethrough disposed in said microtitre plate well spacing; a second gasket, having a releasably adhering surface, sealingly coupling the second plate to the second planar substrate to form the second stack, the second gasket having wells disposed in said microtitre plate well spacing and fluidically coupled to the wells in the second plate and combining with the wells in the second plate to form reaction chambers disposed in said microtitre plate well spacing about the reaction surfaces on the second planar substrate.

5. The apparatus of claim 4, wherein the second joinder member is further engageable with substantially an entire length of side edges of the second plate, the second gasket and the second planar substrate, the second joinder member engageable with the side edges at both a top and bottom of the second stack adjacent to side walls of the second plate, the second joinder member forming a second channel with a second top portion and a second bottom portion, with the second top portion of the second channel extending outwardly from the central portion of the first channel of the second joinder member, the second top portion engageable along the entire length at the top of the second stack, the second bottom portion of the second channel extending outwardly from the central portion of the first channel of the second joinder member and engageable along the entire length at the bottom of the second stack; and wherein the central portion of the first channel of the second joinder member is sized to maintain the microtitre plate well spacing across the first and second stacks, wherein the first and second stacks are positioned side-by-side.

6. The apparatus of claim 5 wherein each of the first and second stacks are individually joined by the second joinder member via the first and second channels of the second joinder member, wherein the second joinder member maintains compressive engagement of the first stack when the second stack is slidably disengaged.

7. The apparatus of claim 6, wherein the first stack and the second stack have an equal number of wells, and wherein the first and second stacks are arranged into a unitary planar array, with the wells in the first and second stacks maintaining the microtitre plate well spacing across the array.

8. The apparatus of claim 7, further comprising a tray, the tray defining a foot print of a microtitre plate.

9. The apparatus of claim 8, wherein the tray receives the first and second stacks.

10. The apparatus of claim 9, where the tray includes an opening shaped to receive and support the first stack with the first and second joinder members joining the first stack, wherein the first joinder member is received adjacent to a side wall of the opening.

11. A reaction surface array diagnostic apparatus comprising:

a first stack, the first stack including a first planar substrate with a plurality of reaction surfaces predeposited in bound arrays on the first planar substrate; a first plate having a plurality of wells extending therethrough disposed in a standard microtitre plate well spacing; a first gasket, having a releasably adhering surface, sealingly coupling the first plate to the first planar substrate to form the first stack, the first gasket having wells disposed in said microtitre plate well spacing and fluidically coupled to the wells in the first plate and combining with the wells in the first plate to form reaction chambers disposed in said microtitre plate well spacing about the reaction surfaces on the first planar substrate;

a second stack, the second stack including a second planar substrate adapted with a plurality of reaction surfaces predeposited in bound arrays on the second planar substrate; a second plate having a plurality of wells extending therethrough disposed in said microtitre plate well spacing; a second gasket, having a releasably adhering surface, sealingly coupling the second plate to the second planar substrate to form the second stack, the second gasket having wells disposed in said microtitre plate well spacing and fluidically coupled to the wells in the second plate and combining with the wells in the second plate to form reaction chambers disposed in said microtitre plate well spacing about the reaction surfaces on the second planar substrate;

first and second joinder members engaged with side edges of the first stack, each of the joinder members engaged with the side edges at both a top and bottom of the first stack adjacent to side walls of the first plate, each of the joinder members forming a first channel with a top portion, a bottom portion, and a central portion, with the top portion of the first channel extending outwardly from the central portion, the top portion engaged along the top of the first stack, the bottom portion of the first channel extending outwardly from the central portion and engaged along the bottom of the first stack; and a third joinder member, the second and third joinder members engaged with side edges of the second stack, each of the second and third joinder members engaged with the side edges at both a top and bottom of the second stack adjacent to side walls of the second plate, the second joinder member forming a second channel with a top portion, a bottom portion, and the central portion of the first channel of the second joinder member, with the top portion of the second channel extending outwardly from the central portion, the top portion engaged along the top of the second stack, the bottom portion of the second channel extending outwardly from the central portion and engaged along the bottom of the second stack, the third joinder member also forming a channel with a top portion, a bottom portion, and a central portion, with the top portion of the channel extending outwardly from the central portion, the top portion engaged along the top of the second stack, the bottom portion of the channel extending outwardly from the central portion and engaged along the bottom of the second stack, wherein said microtitre plate well spacing is maintained across the wells of the first and second stacks.

12. The apparatus of claim 11 wherein each of the first and second joinder members are slidably and compressibly engaged with the first stack, and each of the second and third joinder members are slidably and compressibly engaged with the second stack.

13. The apparatus of claim 12 wherein the central portion of the first channel of the second joinder member is sized to maintain the microtitre plate well spacing across the first and second stacks, wherein the first and second stacks are positioned side-by-side.

14. The apparatus of claim 12 wherein each of the first and second stacks are individually joined by the second joinder member via the first and second channels of the second joinder member, wherein the second joinder member maintains compressive engagement of the first stack when the second stack is slidably disengaged.

15. The apparatus of claim 14, wherein the first stack has an equal number of wells as the second stack.

16. The apparatus of claim 15, further comprising a tray, the tray defining a foot print of a microtitre plate.

17. The apparatus of claim 16, wherein the tray receives the first and second stacks.

18. The apparatus of claim 17, wherein the tray includes an opening shaped to receive and support the first stack with the first and second joinder members joining the first stack, wherein the first joinder member is received adjacent to a side wall of the opening.

* * * * *